United States Patent [19]

Heyne et al.

[11] Patent Number: 4,912,443

[45] Date of Patent: Mar. 27, 1990

[54] SUPERCONDUCTING MAGNETIC ENERGY STORAGE INDUCTOR AND METHOD OF MANUFACTURE

[75] Inventors: Carl J. Heyne, Hampton Twp., Allegheny county; Jeffrey R. Repp, Penn Township, Westmoreland county; Donald T. Hackworth, Monroeville, all of Pa.

[73] Assignee: Westinghouse Electric Corp., Pittsburgh, Pa.

[21] Appl. No.: 306,363

[22] Filed: Feb. 6, 1989

[51] Int. Cl.[4] ..... H01F 7/22

[52] U.S. Cl. ..... 335/216; 174/125.1

[58] Field of Search ..... 335/216, 299, 300; 174/15.5, 15.4, 125.1

[56] References Cited

U.S. PATENT DOCUMENTS

| | | | |
|---|---|---|---|
| 3,332,047 | 7/1967 | Borchert | 174/125.1 X |
| 3,444,307 | 5/1969 | Kafka | 174/15.5 |
| 3,686,422 | 8/1972 | Doose | 174/15 |
| 3,801,942 | 4/1974 | Elsel | 335/216 |
| 3,869,686 | 3/1975 | Benz | 335/216 |
| 4,122,512 | 10/1978 | Peterson et al. | 363/14 |
| 4,418,325 | 11/1983 | Elsel | 335/216 |
| 4,421,946 | 12/1983 | Furuto et al. | 174/128 |
| 4,447,670 | 5/1984 | Eckels | 174/15 |
| 4,482,878 | 11/1984 | Burgeson et al. | 335/216 |
| 4,549,156 | 10/1985 | Mine et al. | 335/216 |
| 4,554,407 | 11/1985 | Ceresara et al. | 174/128 |
| 4,568,900 | 2/1986 | Agatsuma et al. | 335/216 |
| 4,622,531 | 11/1986 | Eyssa et al. | 335/216 |
| 4,652,697 | 3/1987 | Ando et al. | 174/128 |
| 4,665,611 | 5/1987 | Sadakata et al. | 29/599 |
| 4,687,883 | 8/1987 | Flükiger et al. | 174/126 |
| 4,692,560 | 9/1987 | Hotta et al. | 174/15 |
| 4,702,825 | 10/1987 | Selvaggi et al. | 209/224 |
| 4,739,202 | 4/1988 | Hatanaka et al. | 310/52 |
| 4,743,713 | 5/1988 | Scanlan | 174/128 |

FOREIGN PATENT DOCUMENTS

| | | |
|---|---|---|
| 2205414 | 8/1978 | Fed. Rep. of Germany . |
| 56-18689 | 1/1984 | Japan . |
| 2021881 | 5/1979 | United Kingdom . |

*Primary Examiner*—George Harris

[57] ABSTRACT

A superconducting coil conductor composed of a plurality of strands (10) twisted together to form a cylindrical structure, each strand (10) being composed of a core (2) composed of a plurality of parallel filaments of a superconducting material, enclosed by a metal sheath (4) forming a matrix in which at least some of the filaments are embedded, and a tubular member (6) enclosing the sheath (4) so as to be in intimate electrical contact with the sheath (4) and support the core (2).

The conductor is held in support plates (16) each presenting a U-shaped conductor support channel (20) spaced inwardly from an exterior surface of the support plate (16) which is in contact with the cryogen, and a conductor compression wedge (18) inserted in the channel (20) for holding the conductor in place.

The solenoid coil further includes insulating members (38) interposed between the support plates (16) and projecting radially beyond the conductor support system.

This coil is radially supported by a plurality of rigid radial support units (46,60) spaced apart along the circumference of the coil and located between the coil and an enclosure side wall, each support unit (46,60) including a support structure (46) having a bearing surface (50) which contacts the coil and which includes support grooves (48) receiving the coil insulating members (38).

For installing the support units (46,60) at room temperature, the coil is subjected to radial inward compressive forces which are retained until the support units (46,60) have been installed, the radial forces then being removed.

15 Claims, 4 Drawing Sheets

SUPERCONDUCTING MAGNETIC ENERGY STORAGE INDUCTOR AND METHOD OF MANUFACTURE

BACKGROUND OF THE INVENTION

The present invention relates to superconducting magnetic energy storage devices, particularly in the form of solenoid coils which are installed in annular enclosures, possibly below ground.

The unique electrical properties of superconductors have led to proposals for storing large quantities of electrical energy in large superconducting coils, one type of which would be an annular solenoid installed, possibly below ground, so that its axis is vertical. The proposed solenoids would have a substantial axial height and diameter, the diameter possibly being of the order of 500 to 1000 meters or more.

The superconductive materials which are currently usable in practice, such as NbTi, must be maintained at a temperature in the vicinity of 1°–4° K. in order to exhibit superconducting properties. Such temperatures can be established by surrounding the superconducting material with successive envelopes of cryogens having progressively higher boiling points.

For example, it is known to use, for this purpose, an envelope of helium, which can be made to have a boiling point lower than 4° K., surrounded by an envelope of neon, having a boiling point of in the vicinity of 28° K., the latter being surrounded by an envelope of nitrogen, having a boiling point in the vicinity of 77° K. Each of these cryogens is maintained in the liquid state by a suitable refrigeration system.

During cooldown of such a coil from room temperature to superconducting temperatures, and during subsequent operation in which cyclically varying radial forces are produced by the magnetic fields associated with the coil, the coil conductors will be subjected to stresses in the direction of their length. If these stresses produce even low levels of strain, the conductivity of the stabilizer associated with the conductor will be degraded, and this will degrade the performance of the conductor.

In addition, known structures for supporting such conductors enable the conductors to contact liquid helium only over a limited portion of their circumference, typically of the order of a quarter of their circumference. This makes it difficult to maintain the entire conductor at its superconducting temperature, particularly when conditions occur which cause the cryogen in contact with the conductors to experience a transition from the super fluid state to a two-phase boiling heat transfer condition.

Furthermore, the coil support structures which have already been proposed attempt to deal with the problems of radial contraction stresses during cooldown to superconductive temperatures in ways which cause slipping movements which generate heat due to friction and/or which induce high bending stresses and/or which require the creation of a loose coil pack which will experience insulation abrasion and movement during operation of the coil.

SUMMARY OF THE INVENTION

It is an object of the present invention to provide a novel conductor structure which has a high degree of strain tolerance.

Another object of the invention is to provide a conductor support structure which will provide a high degree of support for the novel conductor while allowing intimate contact between the liquid cryogen and the entire circumferential region of the conductor.

A further object of the invention is to provide radial support for an assembled coil which will impose only small radial compression forces on the coil during operation at cryogenic temperatures.

Certain of the above objects, and other objects, are achieved, according to the present invention, by a conductor for a superconducting coil, the conductor comprising a plurality of strands twisted together to form a cylindrical structure, and each strand comprising:

a core composed of a plurality of parallel filaments of a material capable of exhibiting superconductivity;

a sheath of metal surrounding, and intimately contacting, the core and forming a matrix in which at least some of the filaments are embedded; and a tubular member of high purity aluminum enclosing the sheath so as to be in intimate electrical contact with the sheath and support the core.

Objects according to the invention are further achieved by a method of fabricating the above-described conductor for a superconducting coil comprising:

forming a conductor strand by: providing a core composed of a plurality of parallel filaments of a material capable of exhibiting superconducting; forming a sheath of metal around the core and radially compressing the sheath against the core to form a matrix in which at least some of the filaments are embedded; and placing the sheath into a C-shaped stabilizer member and then bending the member into the form of a closed tube which is pressed radially against the sheath; and twisting a plurality of the strands together to form the conductor.

Objects according to the invention are further achieved by the provision of a support for a superconducting conductor which is to be immersed in a liquid cryogen, comprising: a support plate having one exterior surface which is to be in contact with the cryogen, and formed to present a U-shaped conductor support channel spaced inwardly from the one exterior surface; and a conductor compression wedge arranged to be inserted in the channel for holding the conductor in place in the channel.

Objects according to the invention are additionally achieved by a system for providing radial support for a superconducting solenoid coil disposed in an annular vessel containing a cryogen, the vessel being surrounded by an enclosure having interior and exterior side walls, the coil including a conductor composed of superconductive material and wound into a helical coil, and a conductor support structure supporting the conductor, the support structure including a plurality of conductor support members spaced apart along the conductor and insulating members interposed between support members associated with adjacent conductor turns, the insulating members projecting in the radial direction of the coil beyond the conductor support members, which system comprises a plurality of radial support units spaced apart along the circumference of the coil and located between the coil and one of the enclosure side walls, each support unit comprising: a first support structure extending over the height of the coil and disposed in radial force transmitting relationship between the coil and the vessel; and a second support structure radially aligned with the first support structure and disposed in radial force transmitting relationship between the vessel and the one enclosure side wall; wherein the first support structure has a bearing surface which contacts the coil and which includes support grooves receiving the coil insulating members.

Objects according to the invention are further achieved by a method for securing a superconducting solenoid coil in an annular enclosure having interior and exterior side walls, the coil experiencing radial contraction forces when being cooled from environmental temperature to cryogenic temperature, the method comprising, in the order recited:

placing the coil in position in the enclosure at environmental temperature and applying radially inwardly directed forces to the coil;

permanently installing substantially rigid radial supports between the coil and the interior and exterior side walls while the coil is at environmental temperature and while continuing to apply the radially inwardly directed forces;

removing the radially inwardly directed forces; and cooling the coil to cryogenic temperature.

DESCRIPTION OF THE PREFERRED EMBODIMENTS

Figure 1A:
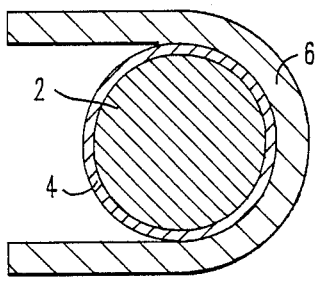
FIG. 1*a* is a cross-sectional view of an initial stage in the fabrication of a conductor according to the present invention.
Figure 1B:
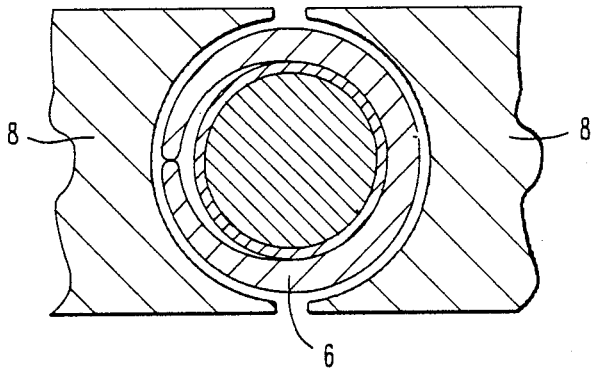
FIG. 1*b* is a cross-sectional view of a subsequent stage in the fabrication of the conductor.
Figure 1C:
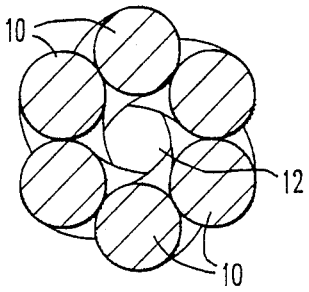
FIG. 1*c* is an end view of a completed conductor according to the present invention.

FIGS. 1*a*, 1*b* and 1*c* illustrate three stages in the fabrication of one conductor according to the present invention. In a first stage, a large number of filaments of a superconductive material, such as NbTi, each filament having a diameter of the order of 20 microns, are twisted together to form a core 2 which is then encased in a copper matrix 4 by an extrusion operation which causes the material matrix 4 to fill most of the spaces between the NbTi filament. Matrix 4 is solder coated and introduced into a stabilizer piece 6 which initially has a C-shape. Stabilizer piece 6 is made of a high purity aluminum which is solder coated.

As an alternative to solder coating the outer surface of matrix 4 and the inner of surface of stabilizer piece 6, these surfaces can be silver plated to produce the desired conductive electrical contact therebetween.

The resulting assembly is then forced through a swaging tool 8, as shown in FIG. 1*b*, or a series of rollers, which gradually bends stabilizer piece 6 into a closed cylindrical form. FIG. 1*b* illustrates an intermediate point in this process. After stabilizer piece 6 has been formed into a closed cylinder which is sealed along the edges of piece 6, the resulting assembly, which constitutes a single superconductor strand 10, is heated to effect annealing and completion of the solder bond between matrix 4 and stabilizer 6. During this treatment, the resulting strand 10 can be heat treated in an oxygen atmosphere in order to form an insulating layer of aluminum oxide on the outer surface of piece 6.

For use in a large coil, core 2 would have a diameter of the order of 3 mm and matrix 4 would have a diameter of the order of 5.5 mm.

Then, as shown in FIG. 1*c*, a plurality of these strands 10 are twisted together in a fully transposed manner to form a completed conductor having a hollow center 12. To form the conductor shown in FIG. 1*c*, strands 10 can be wrapped around a hollow tube of aluminum, which can remain in place or be withdrawn after formation of strand 10, or can be twisted without such hollow tube.

The aluminum oxide coating on the outer surface of each strand 10 will minimize current flow between adjacent strands and the resulting conductor will have low losses. The insulating layer on the outer surface of each strand 10 serves to increase the effective resistance of the conductor to eddy currents. This can also be achieved by reducing the diameter of each strand 10 and increasing the total number of strands 10 in the conductor.

The twist pitch of the resulting conductor is selected to limit the strain in the conductor to an acceptable value during operation of the inductor which is formed by coiling the conductor. A tight twist pitch will cause the conductor to behave like a coiled spring which will allow relatively large changes in the effective length the conductor, corresponding to changes in the diameter of the coil, without significantly increasing the strain experienced by the individual strands 10. For a large coil, which is envisioned to have a diameter of the order of 1 km or more, a twist pitch of 1 m or less is envisioned.

The increased strain tolerance of the resulting conductor, as shown in FIG. 1*c* of necessity reduces its load bearing capability. Therefore, the conductor must be adequately supported, particularly in order to withstand the electromagnetic forces that will exist in the resulting coil, while providing effective thermal communication between the conductor and the cryogen, such as helium, employed to maintain the conductor at a superconducting temperature.

Figure 2A:
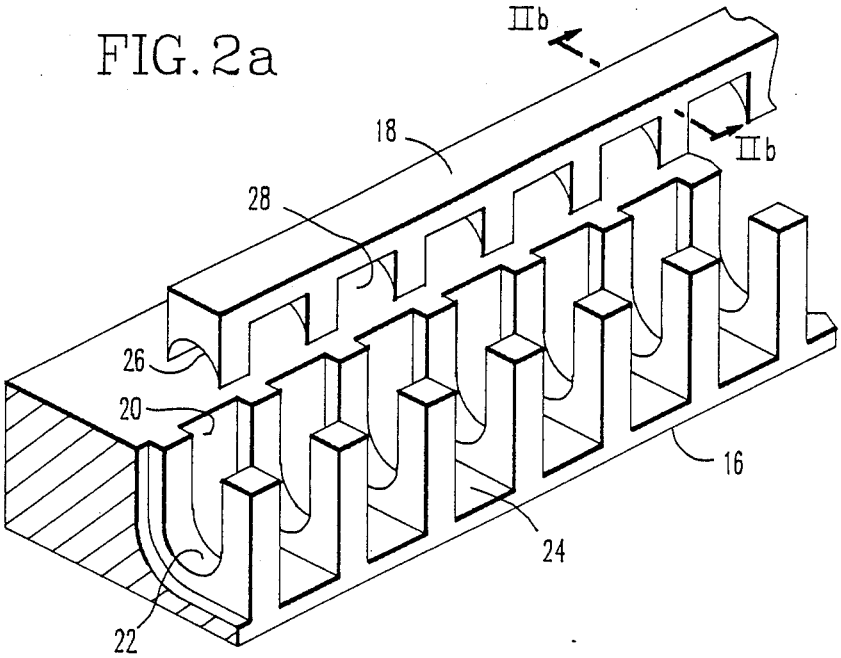
FIG. 2*a* is an exploded, perspective view of a preferred embodiment of a conductor support structure according to the present invention.
Figure 2B:
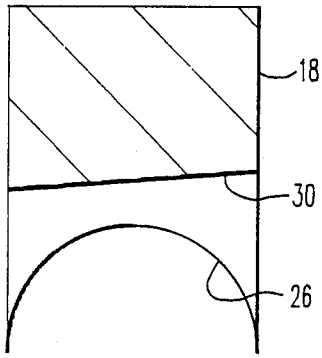
FIG. 2*b* is a cross-sectional view taken along the plane B—B of FIG. 2*a*.

A conductor support structure according to the present invention, which is capable of performing these functions, is illustrated, in exploded form, in FIG. 2*a*. This structure includes a support plate 16 and a conductor compression wedge 18 between which the conductor shown in FIG. 1*c* will be clamped. Support plate 16 is provided with an upwardly extending U-shaped channel 20 in which the conductor will rest. This channel includes, along its length, conductor support regions 22 alternating with channel regions 24 for the circulation of liquid helium around the conductor. Compression wedge 18 includes corresponding conductor engaging regions 26 alternating with channel regions 28 which will cooperate with channel 24 to provide liquid helium flow paths which circulate around the conductor periphery. As shown in FIG. 2*b*, compression wedge 18 is provided, in each channel region 88, with a sloping surface 30 for preventing helium bubble stagnation in the channels. Preferably, the channels formed by regions 24 and 28 are spaced 2–10 cm apart along the length of the support structure.

The complete support structure for a coil would be composed of a plurality of the structures shown in FIG. 2*a* joined together in abutting relationship along the length of the conductor.

Figure 3:
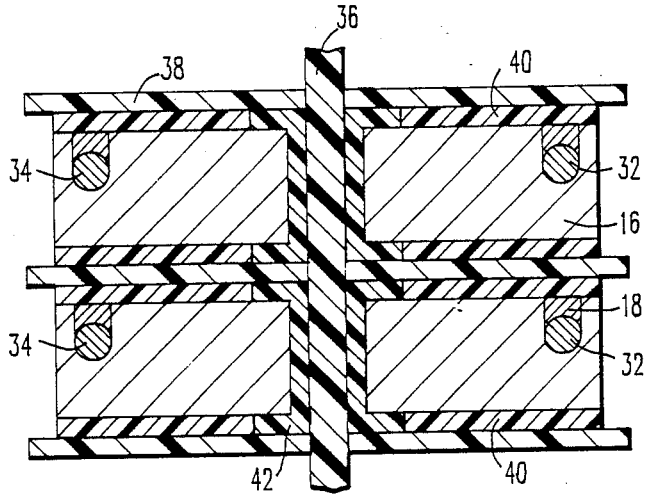
FIG. 3 is a cross-sectional view of a portion of a coil structure according to the present invention.

A portion of a solenoid structure employing conductors as shown in FIG. 1*c* and support structures as shown in FIG. 2*a* is illustrated in FIG. 3, which is a cross-sectional detail view taken in a vertical plane which passes through the coil axis.

In the coil, current is carried by two conductors 32 and 34 which are spaced apart radially. Each conductor is formed into a large number of turns which are spaced apart vertically, or axially, along the coil. Each of conductors 32 and 34 has the structure shown in FIG. 1*c*. Conductors 32 and 34 are supported by supports composed of support plates 16 and compression wedges 18, constructed as shown in FIGS. 2. For supporting each of the conductors 32, 34, a plurality of supports 16, 18 are disposed adjacent one another along the length of the associated conductor so that these supports follow the same helical path as the associated conductor.

Each support, composed of a plate 16 and a wedge 18, is electrically insulated from each adjacent support by an insulation system which includes a vertical insulating member 36, horizontal insulating members 38, horizontal insulating plates 40 and U-shaped insulating corner members 42.

The insulating structure is arranged, as shown in FIG. 3, so that plates 40 and members 42 are interposed between support structures 16, 18 and insulating members 36 and 38. The insulating parts are arranged relative to one another so that the joint between two abutting parts will always be overlapped by another insulating part. For example, as shown, each joint between a plate 40 and a corner member 42 is overlapped by a horizontal insulating member 38. Similarly, in the circumferential direction of the coil, the vertical joints between abutting vertical insulating members 36 and the radial joints between abutting, coplanar horizontal insulating members 38 will be overlapped by insulating corner members 42 and horizontal insulating plates. This overlapping helps to eliminate current leakage paths between conductor sections.

Horizontal insulating members 38 extend radially beyond supports 16, 18 to provide increased strike and creepage distances between conductor sections and to permit engagement with components which provide radial support for the coil.

A coil of the type according to the present invention would be assembled at room temperature, in situ in a trench, by laying each length of a conductor in channel 20 of a support plate 16, inserting wedge 18 and placing a plate 40 and horizontal insulating member 38 upon plate 16 and wedge 18. As successive coil turns are built up, each wedge 18 will be pressed into engagement with its associated conductor section by the weight of the overlying components.

When such a structure is assembled at room temperature, and then cooled to cryogenic temperatures, stresses are created which tend to cause the structure to contract radially. If, as presently envisioned, the coil structure is disposed in an annular, concrete lined trench, radial support for the coil is provided by struts extending radially rom the trench walls. According to the present invention, it is proposed to build the coil in the trench at room temperature and then provide uniform radial force to the coil structure near the intended strut locations, using hydraulic cylinders or similar means. This pre-compression is maintained by then assembling the radial support struts which provide permanent support for the coil while the compression jacks are in place. The value of pre-compression provided before installation of the permanent support struts should be such that, at operating temperatures, the coil will be subjected to only slight compression by the struts. The struts themselves must be stiff enough to withstand the electromagnetic loads on the coil without creating excessive coil strain or stress.

Figure 4B:
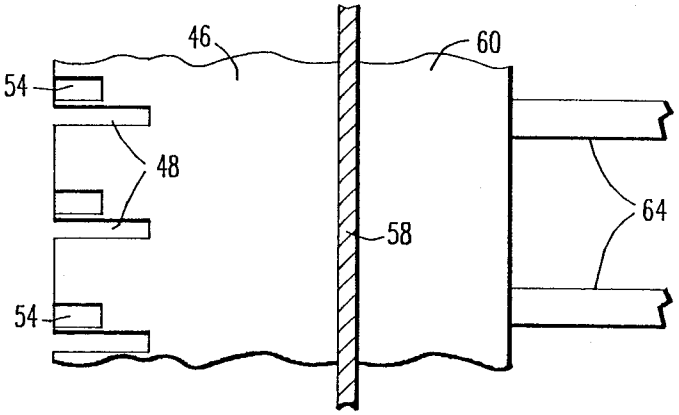
FIG. 4*b* is a side-elevational view of the structure shown in FIG. 4*a*.
Figure 4A:
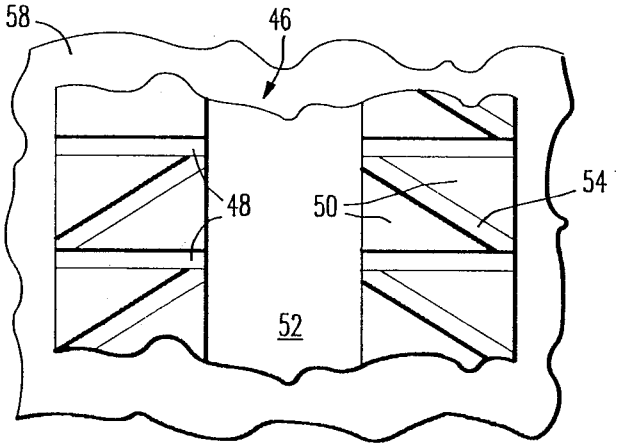
FIG. 4*a* is a detailed, front-elevational view of a portion of a coil support system according to the invention.
Figure 4C:
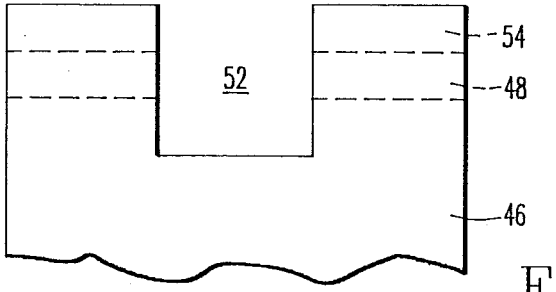
FIG. 4*c* is a plan view of the structure shown in FIG. 4*a*.

A permanent support structure according to the present invention is illustrated in FIGS. 4*a*, 4*b* and 4*c*, which illustrate one portion of one coil support block according to the invention. Support block 46 is a onepiece, vertically extending member provided with insulation receiving grooves 48 into each of which the overhanging portion of a horizontal insulating member 38, as shown in FIG. 3, will be inserted. Block 46 further includes vertical bearing surfaces 50 which will bear against the exterior vertical surfaces of support plates 16 of FIG. 3.

Grooves 48 and surfaces 50 are arranged in two vertical columns separated by a vertical recess 52 constituting a helium storage and bubble exit column.

Support block 46 is further provided with angled helium feed channels 54 along which helium can flow to cool the conductors and to supply helium to channel regions 24 in the areas of contact with surfaces 50.

The coil will be enclosed by a sealed vessel, or dewar, 58 which contains the bath of liquid helium. Each support block 46 bears against the interior wall of vessel 58 and is, in turn, radially supported by a further support member 60, known in the art as a strong back, which also extends over the entire height of the coil. Radial support struts 64 extend between strong back 60 and the concrete trench lining, or support members associated with other cryogen vessels.

A plurality of the assemblies shown in FIGS. 4 will be disposed at intervals around the circumference of the coil and a corresponding plurality of identical assemblies will be disposed along the inner periphery of the coil to provide radial support with the trench lining which is located radially inwardly of the coil.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. A conductor for a superconducting coil, said conductor comprising a plurality of strands twisted together to form a cylindrical structure, and each said strand comprising:

a core composed of a plurality of parallel filaments of a material capable of exhibiting superconductivity;

a sheath of metal surrounding, and intimately contacting, said core and forming a matrix in which at least some of said filaments are embedded; and a tubular member of high purity aluminum enclosing said sheath so as to be in intimate electrical contact with said sheath and support said core.

2. A conductor as defined in claim 1 wherein said strands are twisted together to enclose a hollow interior region.

3. A conductor as defined in claim 1 wherein the outer surface of said sheath and the inner surface of said tubular member are solder coated.

4. A conductor as defined in claim 1 wherein the outer surface of said sheath and the inner surface of said tubular member are silver plated.

5. A conductor as defined in claim 1 wherein, in each said strand, said filaments are twisted together in said core, said core is held in a state of compression by said sheath and said sheath is held in a state of compression by said tubular member.

6. A conductor as defined in claim 1 wherein said sheath is made of copper.

7. A method of fabricating a conductor for a superconducting coil comprising:

forming a conductor strand by: providing a core composed of a plurality of parallel filaments of a material capable of exhibiting superconductivity; forming a sheath of metal around the core and radially compressing the sheath against the core to form a matrix in which at least some of the filaments are embedded; and placing the sheath into a C-shaped stabilizer member and then bending the member into the form of a closed tube which is pressed radially against the sheath; and twisting a plurality of the strands together to form the conductor.

8. A support for a superconducting conductor which is to be immersed in a liquid cryogen, comprising: a support plate having one exterior surface which is to be in contact with the cryogen, and formed to present a U-shaped conductor support channel spaced inwardly from said one exterior surface; and a conductor compression wedge arranged to be inserted in said channel for holding the conductor in pace in the channel.

9. A support as defined in claim 8 wherein said support plate and said wedge are provided with recesses which define a plurality of cryogen flow channels which surround the region occupied by the conductor and are spaced apart in the direction of the length of the conductor.

10. A support as defined in claim 9 wherein each channel has a top wall which slopes upwardly toward said one interior surface.

11. A support as defined in claim 9 wherein said channels are spaced apart by a distance of the order of several centimeters.

12. A system for providing radial support for a superconducting solenoid coil disposed in an annular vessel containing a cryogen, the vessel being surrounded by an enclosure having interior and exterior side walls, the coil including a conductor composed of superconductive material and wound into a helical coil, and a conductor support structure supporting the conductor, the support structure including a plurality of conductor support members spaced apart along the conductor and insulating members interposed between support members associated with adjacent conductor turns, the insulating members projecting in the radial direction of the coil beyond the conductor support members, said system comprising a plurality of radial support units space apart along the circumference of the coil and located between the coil and one of the enclosure side walls, each said support unit comprising: first support means extending over the height of the coil and disposed in radial force transmitting relationship between the coil and the vessel; and second support means radially aligned with said first support means and disposed in radial force transmitting relationship between the vessel and the one enclosure side wall; wherein said first support means has a bearing surface which contacts the coil and which includes support grooves receiving the coil insulating members.

13. A system as defined in claim 12 in combination with the recited conductor support structure, wherein each said conductor support member comprises: a support plate having one exterior surface which is to be in contact with the cyogen, and formed to present a U-shaped conductor support channel spaced inwardly from said one exterior surface; and a conductor compression wedge arranged to be inserted in said channel for holding the conductor in place in said channel.

14. A method for securing a superconducting solenoid coil in an annular enclosure having interior and exterior side walls, the coil experiencing radial contraction forces when being cooled from environmental temperature to cryogenic temperature, said method comprising, in the order recited:

placing the coil in position in the enclosure at environmental temperature and applying radially inwardly directed forces to the coil;

permanently installing substantially rigid radial supports between the coil and the interior and exterior side walls while the coil is at environmental temperature and while continuing to apply the radially inwardly directed forces;

removing the radially inwardly directed forces; and cooling the coil to cryogenic temperature.

15. A method as defined in claim 14 wherein the magnitude of forces applied during said step of applying is selected to minimize the radial stress imposed on the coil when cooled to cryogenic temperature.

* * * * *